US008584835B2

(12) United States Patent
Still

(10) Patent No.: US 8,584,835 B2
(45) Date of Patent: Nov. 19, 2013

(54) PROTECTIVE COVERINGS AND METHODS OF MAKING AND USING THE SAME

(76) Inventor: Russell F. Still, Cumming, GA (US)

( * ) Notice: Subject to any disclaimer, the term of this patent is extended or adjusted under 35 U.S.C. 154(b) by 298 days.

(21) Appl. No.: 13/070,918

(22) Filed: Mar. 24, 2011

(65) Prior Publication Data

US 2012/0241330 A1 Sep. 27, 2012

(51) Int. Cl.
*B65D 25/24* (2006.01)
*B65D 5/52* (2006.01)

(52) U.S. Cl.
USPC ..... 206/45.24; 206/320

(58) Field of Classification Search
USPC ..... 206/45.24, 45.23, 45.2, 320, 304.2, 206/701, 45.25, 45.26
See application file for complete search history.

(56) References Cited

U.S. PATENT DOCUMENTS

| | | | | |
|---|---|---|---|---|
| 2,131,093 | A | 9/1938 | Cage | |
| 3,913,711 | A | 10/1975 | Schmid | |
| 4,070,489 | A | 1/1978 | Pahnke | |
| 4,708,239 | A | 11/1987 | Bourbon | |
| 4,972,943 | A | 11/1990 | Fludd | |
| 5,046,739 | A | 9/1991 | Reichow | |
| 5,188,223 | A | 2/1993 | Brose et al. | |
| 5,501,458 | A | 3/1996 | Mallory | |
| D432,586 | S | 10/2000 | Galli-Zugaro et al. | |
| D434,811 | S | 12/2000 | Aleman | |
| 6,241,247 | B1 | 6/2001 | Sternberg et al. | |
| 6,561,349 | B2 | 5/2003 | Lee | |
| 6,932,341 | B1 | 8/2005 | Kenyon | |
| 6,995,976 | B2 * | 2/2006 | Richardson | 345/173 |
| 7,046,508 | B2 | 5/2006 | Lin | |
| D555,667 | S | 11/2007 | Hussaini et al. | |
| 7,637,376 | B2 | 12/2009 | Silva et al. | |
| D624,601 | S | 9/2010 | Grossman | |
| D632,341 | S | 2/2011 | Lim et al. | |
| D632,742 | S | 2/2011 | Mueller | |
| D632,743 | S | 2/2011 | Mueller | |
| D642,792 | S * | 8/2011 | Tremblay | D3/218 |
| D676,837 | S * | 2/2013 | Rothbaum et al. | D14/250 |
| 2005/0247584 | A1 * | 11/2005 | Lu | 206/320 |
| 2007/0165371 | A1 * | 7/2007 | Brandenburg | 361/683 |
| 2007/0256946 | A1 * | 11/2007 | Godshaw et al. | 206/320 |
| 2008/0029413 | A1 * | 2/2008 | Brandenburg | 206/320 |
| 2009/0272661 | A1 * | 11/2009 | Liu | 206/320 |

* cited by examiner

*Primary Examiner* — Luan K Bui
*Assistant Examiner* — Rafael Ortiz
(74) *Attorney, Agent, or Firm* — Withers & Key, LLC

(57) ABSTRACT

Protective coverings suitable for protecting and housing electronic devices such as a KINDLE™ ebook reader or an APPLE™ iPAD™ tablet are disclosed. Methods of making and using protective coverings are also disclosed.

20 Claims, 10 Drawing Sheets

PROTECTIVE COVERINGS AND METHODS OF MAKING AND USING THE SAME

FIELD OF THE INVENTION

The present invention relates generally to protective coverings suitable for protecting and housing electronic devices such as an APPLE™ iPad™ tablet computer. The present invention further relates to methods of making and using protective coverings suitable for protecting and housing electronic devices.

BACKGROUND OF THE INVENTION

Numerous products exist that act as a stand and/or a carrying case for a class of flat electronic/computer devices such as an APPLE™ iPad™ tablet computer. However, known devices lack one or more desirable features. For example, known devices typically do not allow a pilot to position the device in the pilot's lap easily. Typically, the device does not stay stationary in the pilot's lap and has a tendency to slip off.

What is needed in the art is a protective device that (i) protects and houses an electronic device such as an APPLE™ iPad™ tablet computer, (ii) allows for easy operation, and (iii) remains stationary during use.

SUMMARY OF THE INVENTION

The present invention provides a protective device that (i) protects and houses an electronic device such as an APPLE™ iPad™ tablet computer, (ii) allows for easy operation, and (iii) remains stationary during use. Thus, a person, such as a pilot, may position the protective device of the present invention within the person's lap, attach the protective device to one of the person's legs (e.g., thighs), and easily use the protective device.

The present invention is directed to protective devices (also referred to herein as "protective coverings") for protecting and housing an electronic device. In one exemplary embodiment of the present invention, the protective device of the present invention comprises (I) a housing component comprising (a) a lower housing layer comprising a rear housing surface and an inner housing surface opposite the rear housing surface, the rear housing surface having a concave surface configuration extending along at least a portion of the rear housing surface in a length direction; (b) one or more housing side walls extending along a peripheral edge of the lower housing layer, each of the one or more housing side walls extending upward from the lower housing layer and comprising an outer housing side wall surface and an inner housing side wall surface opposite the outer housing side wall surface; and (c) at least one housing connection member extending along one of the one or more housing side walls; and (II) a door component comprising (a) an upper door layer comprising an upper door surface, an inner door surface opposite the upper door surface, a connected door end, and a moveable door end opposite the connected door end; and (b) at least one door connection member along the connected door end; the door component being connected to the housing component along the connected door end so that the moveable door end is operatively adapted to move from (i) a first closed position wherein the inner door surface extends over the inner housing surface to (ii) a second open position wherein the inner door surface faces upward and the inner housing surface is completely exposed.

In another exemplary embodiment of the present invention, the protective covering comprises a protective covering for protecting and housing an electronic device, wherein the protective covering comprises (I) a housing component having a rectangular shape, an upper housing edge, a lower housing edge opposite said upper housing edge, a first housing side edge connecting the upper housing edge and the lower housing edge, and a second housing side edge connecting the upper housing edge and the lower housing edge and being opposite the first housing side edge, the housing component comprising a shaped polymeric material comprising (a) a lower housing layer comprising a rear housing surface and an inner housing surface opposite the rear housing surface, the rear housing surface having a concave surface configuration along at least a portion of the rear housing surface, and the inner housing surface having a substantially planar surface configuration within a first plane; (b) (i) an upper edge housing side wall extending along at least a portion of the upper housing edge, (ii) a lower edge housing side wall extending along at least a portion of the lower housing edge, (iii) a first side edge housing side wall extending along at least a portion of the first housing side edge, and (iv) a second side edge housing side wall extending along at least a portion of the second housing side edge; and (c) a housing connection member extending along the first side edge housing side wall; (II) (i) one or more straps extending from the housing component and (ii) one or more strap locking mechanisms operatively adapted to temporarily secure a length of the one or more straps in a fixed position, the one or more straps being operatively adapted and sized to extend around a person's thigh so as to attach the protective covering to the person's thigh; and (III) a door component having a square or rectangular configuration, an upper door edge, a lower door edge opposite the upper door edge, a first door side edge connecting the upper door edge to the lower door edge, and a second door side edge connecting the upper door edge to the lower door edge, the second door side edge being opposite the first door side edge, the door component comprising a shaped polymeric material comprising (a) an upper door layer comprising an upper door surface, an inner door surface opposite the upper door surface, a connected door end, and a moveable door end opposite the connected door end, each of the upper door surface and the inner door surface being substantially planar and extending within second and third planes respectively, the second and third planes being substantially parallel with the first plane when the door component is in a first closed position; and (b) at least one door connection member extending along the connected door end; the door component being connected to the housing component along the connected door end so that the moveable door end is operatively adapted to move from (i) the first closed position wherein the inner door surface extends over the inner housing surface to (ii) a second open position wherein the inner door surface faces upward and the inner housing surface is completely exposed; wherein when the door component is in the first closed position, (1) each of the lower door edge, the first door side edge and the second door side edge is aligned with each of the lower housing edge, the first housing side edge and the second housing side edge respectively, (2) the upper door edge extends along the housing component such that all of the upper housing edge and portions of the first housing side edge and the second housing side edge are exposed; and (3) each of (i) the upper edge housing side wall, (ii) the lower edge housing side wall, (iii) the first side edge housing side wall and (iv) the second side edge housing side wall comprises an opening or cut-out therein so as to enable access to one or more controls or ports positioned along an electronic device positioned within the housing component.

In yet another exemplary embodiment of the present invention, the protective covering comprises a protective covering for protecting and housing an electronic device, wherein the protective covering comprises (I) a housing component having a rectangular shape, an upper housing edge, a lower housing edge opposite the upper housing edge, a first housing side edge connecting the upper housing edge and the lower housing edge, and a second housing side edge connecting the upper housing edge and the lower housing edge and being opposite the first housing side edge, the housing component comprising a shaped polymeric material comprising (a) a lower housing layer comprising a rear housing surface and an inner housing surface opposite the rear housing surface, the rear housing surface having a concave surface configuration along at least a portion of the rear housing surface, and the inner housing surface having a substantially planar surface configuration within a first plane, the rear housing surface further comprises a recessed groove extending along the rear housing surface; (b) (i) an upper edge housing side wall extending along at least a portion of the upper housing edge, (ii) a lower edge housing side wall extending along at least a portion of the lower housing edge, (iii) a first side edge housing side wall extending along at least a portion of the first housing side edge, and (iv) a second side edge housing side wall extending along at least a portion of the second housing side edge; and (c) a housing connection member along the first side edge housing side wall; (II) (i) one or more straps extending from the housing component and (ii) one or more strap locking mechanisms operatively adapted to temporarily secure a length of the one or more straps in a fixed position, the one or more straps being operatively adapted and sized to extend around a person's thigh so as to attach the protective covering to the person's thigh; (III) a door component having a square or rectangular configuration, an upper door edge, a lower door edge opposite the upper door edge, a first door side edge connecting the upper door edge to the lower door edge, and a second door side edge connecting the upper door edge to the lower door edge, the second door side edge being opposite the first door side edge, the door component comprising a shaped polymeric material comprising (a) an upper door layer comprising an upper door surface, an inner door surface opposite the upper door surface, a connected door end, and a moveable door end opposite the connected door end, each of the upper door surface and the inner door surface being substantially planar and extending within second and third planes respectively, the second and third planes being substantially parallel with the first plane when the door component is in a first closed position; and (b) at least one door connection member extending along the connected door end; said door component being connected to the housing component along the connected door end so that the moveable door end is operatively adapted to move from (i) the first closed position wherein the inner door surface extends over the inner housing surface to (ii) a second open position wherein the inner door surface faces upward and the inner housing surface is completely exposed; (IV) a clip member positioned along the upper door surface, the clip member being operatively adapted and sized to clip objects to the upper door surface; and (V) a fold-out prop member comprising a connected fold-out prop member end, and a moveable fold-out prop member end opposite the connected fold-out prop member end, the connected fold-out prop member end being connected to or proximate to the rear housing surface so that the moveable fold-out prop member end is operatively adapted to move from (i) a first parallel position wherein the moveable fold-out prop member end extends along and is proximate to the rear housing surface to (ii) a second angled position wherein the moveable fold-out prop member end is positioned away from the rear housing surface, the fold-out prop member being sized so as to fit within the recessed groove when the fold-out prop member is in the first parallel position; wherein when the door component is in the first closed position, (1) each of the lower door edge, the first door side edge and the second door side edge is aligned with each of the lower housing edge, the first housing side edge and the second housing side edge respectively, (2) the upper door edge extends along the housing component such that all of the upper housing edge and portions of the first housing side edge and the second housing side edge are exposed; and (3) each of (i) the upper edge housing side wall, (ii) the lower edge housing side wall, (iii) the first side edge housing side wall and (iv) the second side edge housing side wall comprises an opening or cut-out therein so as to enable access to one or more controls or ports positioned along an electronic device positioned within the housing component.

The present invention is also directed to any of the herein described protective coverings in combination with an electronic device (e.g., an APPLE™ iPad™ tablet computer). The protective covering and electronic device are independently sized so that the electronic device can be secured within a housing component of the protective covering and positioned within the housing component when a door component of the protective covering is in a closed position.

The present invention is also directed to methods of making protective coverings. In one exemplary embodiment of the present invention, the method of making a protective covering comprises the step of forming at least one molded part comprising (i) the housing component, (ii) the fold-out prop member, and (iii) the door component; and connecting (i) the housing component, (ii) the fold-out prop member, and (iii) the door component. The method of making a protective covering may further comprise one or more additional steps including, but not limited to, printing and/or adhering an image onto an outer surface of the at least one molded part; attaching one or more self-adhesive pads along one or more surfaces of the housing component; and packaging the protective covering.

The present invention is further directed to methods of using a protective covering to protect and house an electronic device. In one exemplary embodiment of the present invention, the method of using a protective covering comprises a method of covering an electronic device, wherein the method comprises positioning the electronic device along an inner surface of the housing component; and closing the protective covering so as to protect and house the electronic device within the housing component.

In another exemplary embodiment, the method of using a protective covering comprises opening a protective covering having an electronic device positioned therein; withdrawing a fold-out prop member from a first position adjacent a lower surface of the housing component; and adjusting a height of the electronic device by adjusting a position of the fold-out prop member relative to the housing component.

In yet another exemplary embodiment, the method of using a protective covering comprises strapping a protective covering to a person's thigh; optionally attaching one or more cords (e.g., a power cord) to an electronic device positioned within a housing component of the protective covering; and opening a door component of the protective covering to access an upper surface of the electronic device (e.g., a touch screen of the electronic device) positioned within the housing component of the protective covering.

These and other features and advantages of the present invention will become apparent after a review of the following detailed description of the disclosed embodiments and the appended claims.

BRIEF DESCRIPTION OF THE FIGURES

The present invention is further described with reference to the appended figures, wherein.

DETAILED DESCRIPTION OF THE INVENTION

The present invention is directed to protective coverings suitable for protecting and housing electronic devices such as a KINDLE™ ebook reader or an APPLE™ iPAD™ tablet. The present invention is further directed to methods of making, as well as methods of using protective coverings suitable for protecting and housing electronic devices.

Figure 1:
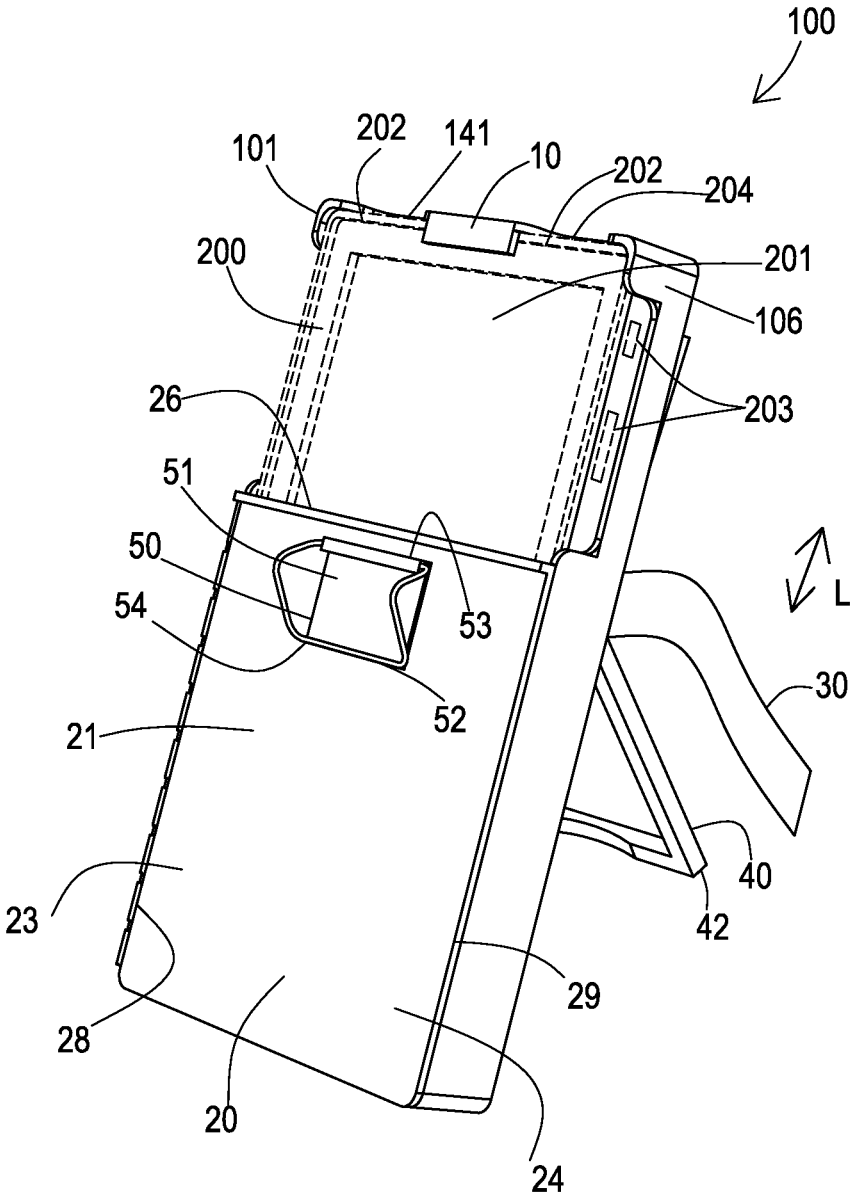
FIG. 1 depicts a view of an exemplary protective covering of the present invention with an exemplary electronic device positioned within a housing component of the exemplary protective covering.
Figure 2:
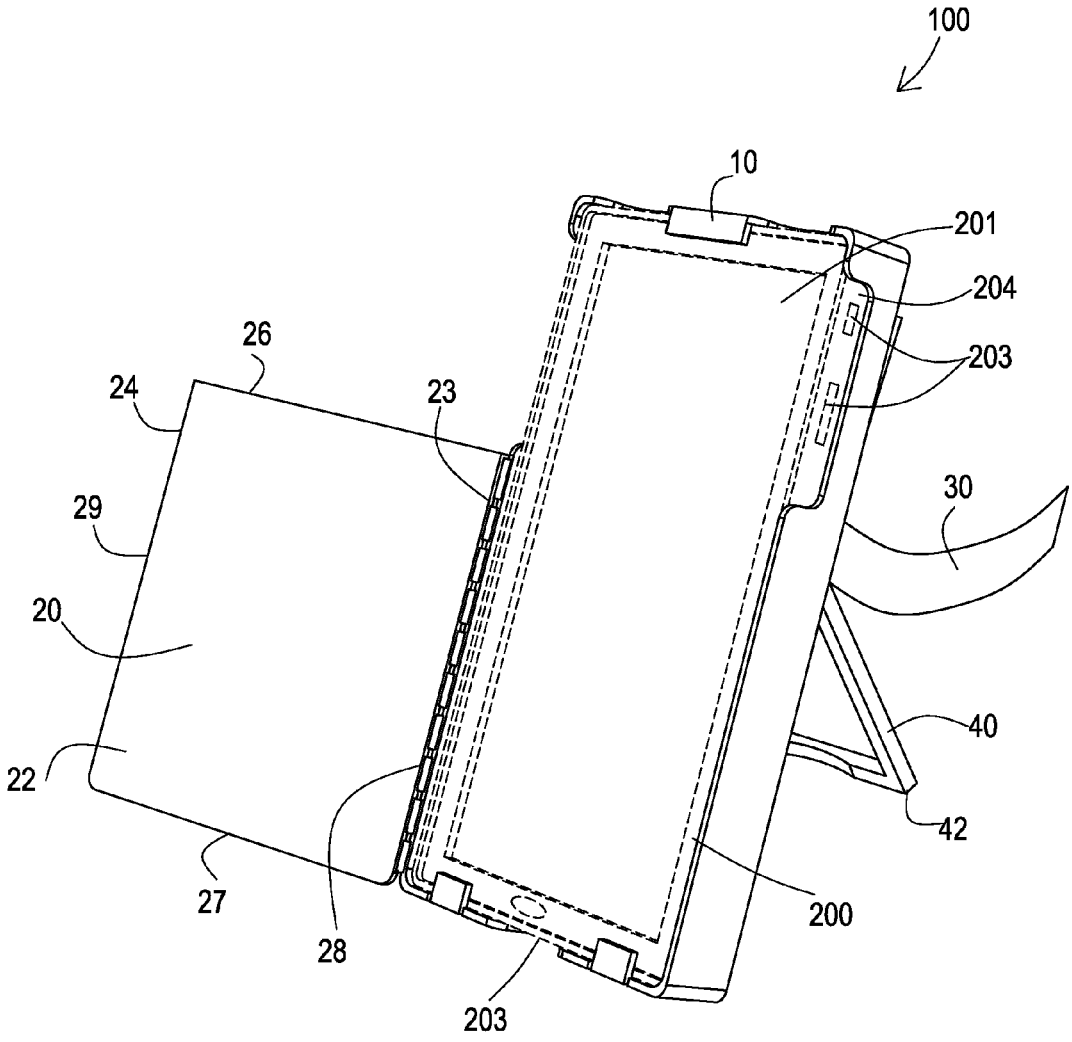
FIG. 2 depicts a side view of the exemplary protective covering shown in FIG. 1 in an opened configuration, namely, with a door component of the exemplary protective covering in an open position.
Figure 3:
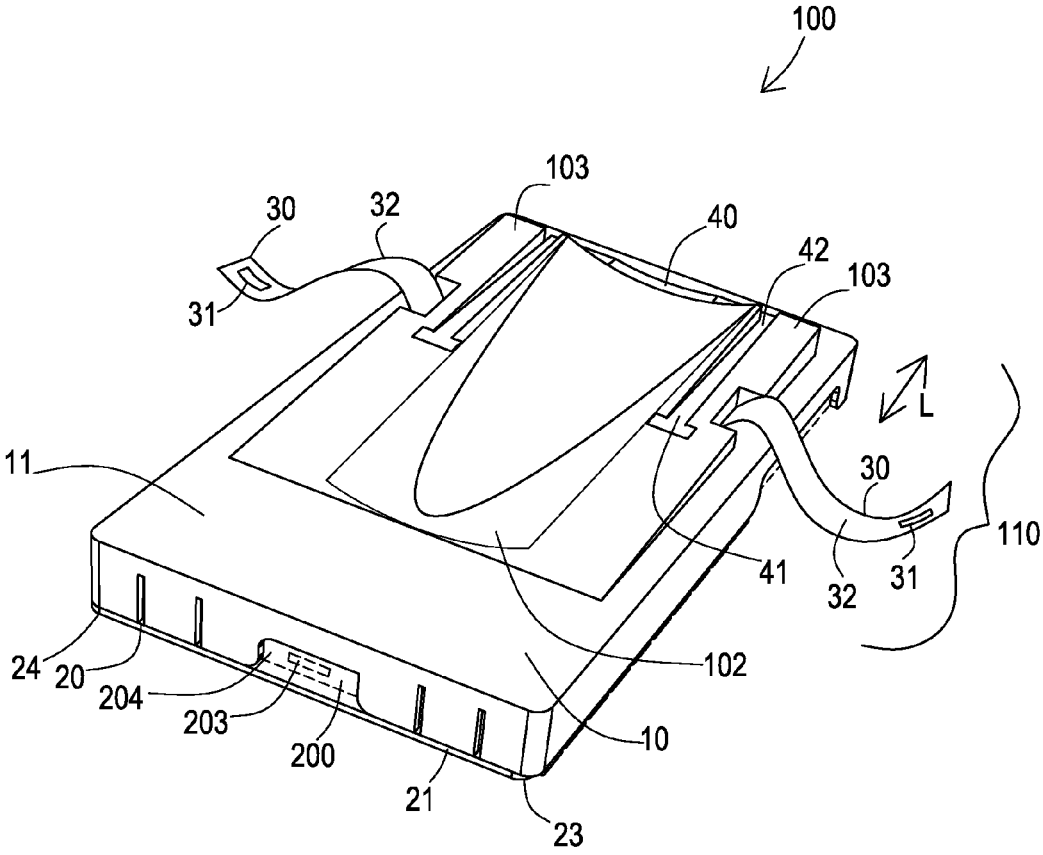
FIG. 3 depicts a rear view of the exemplary protective covering shown in FIG. 1.

An exemplary protective covering of the present invention with an exemplary electronic device positioned within a housing component of the exemplary protective covering is depicted in FIGS. 1-3. As shown in FIG. 1, exemplary protective covering 100 comprises an exemplary housing component 10 with an exemplary electronic device 200 positioned within exemplary housing component 10. Exemplary protective covering 100 also comprises an exemplary door component 20 attached to exemplary housing component 10. Exemplary protective covering 100 further comprises the following components: an exemplary strap component 30 attached to exemplary housing component 10; an exemplary fold-out prop member 40 attached to exemplary housing component 10; and an exemplary clip member 50 attached to an upper door surface 21 of exemplary door component 20.

FIG. 2 depicts a side view of exemplary protective covering 100 shown in FIG. 1 in an opened configuration (also, referred to herein as "a first open position"), namely, with exemplary door component 20 of exemplary protective covering 100 in an open position. In the open position, exemplary housing component 10 and exemplary electronic device 200 positioned therein are exposed so that an entire screen 201 (e.g., a touch screen) is in view for a user.

As discussed further below, even when exemplary protective covering 100 is in a "closed" position as shown in FIG. 1, exemplary housing component 10 is designed to provide access to one or more controls 202 and/or ports 203 alongside edges 204 of exemplary electronic device 200 (e.g., an APPLE™ iPad™ tablet computer).

FIG. 3 depicts a rear view of exemplary protective covering 100 shown in FIG. 1. As discussed further below, rear housing surface 11 of exemplary housing component 10 has a concave surface configuration 110 extending along at least a portion of rear housing surface 11 in a length direction designated by arrow L shown in FIG. 3.

As shown in FIGS. 1-3, protective coverings of the present invention may comprise a number of components. A description of individual components and combinations of individual components is provided below.

I. Device Components

The protective coverings of the present invention may comprise one or more of the following components.

A. Housing Component

Figure 4:
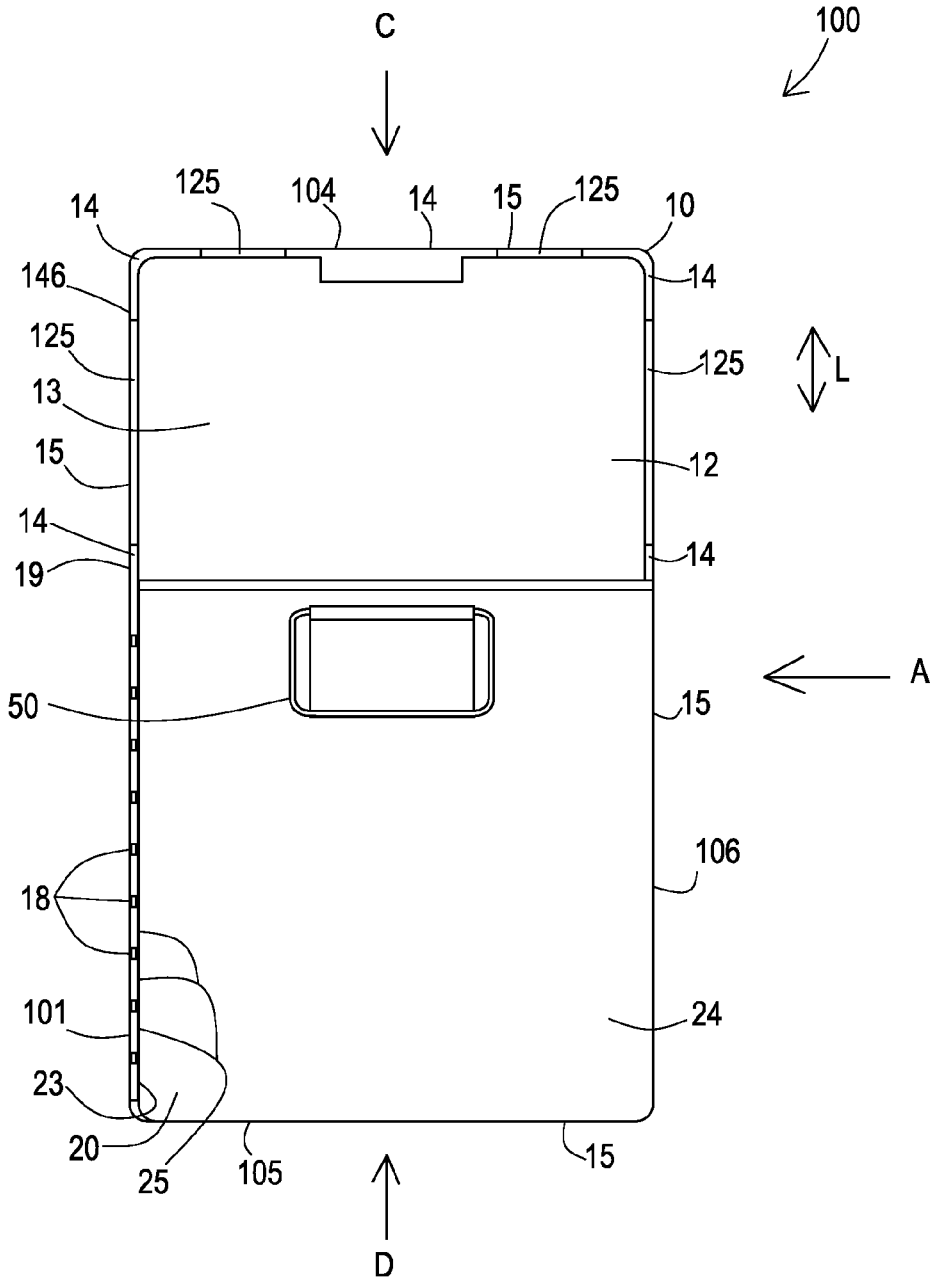
FIG. 4 depicts a frontal view of the exemplary protective covering shown in FIG. 1 in a closed configuration with the exemplary electronic device removed from the housing component of the exemplary protective covering.
Figure 5:
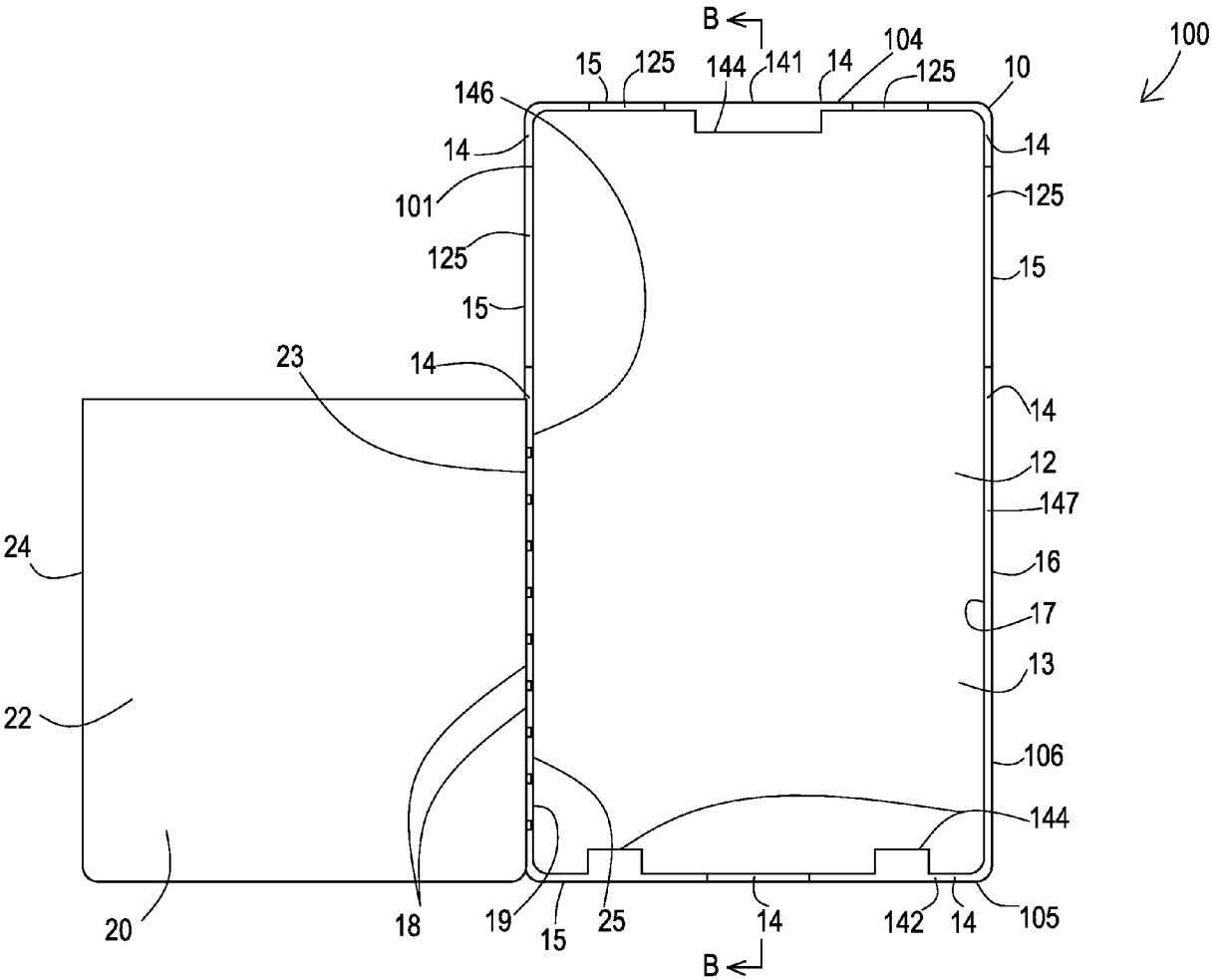
FIG. 5 depicts a frontal view of the exemplary protective covering shown in FIG. 4 in an open configuration.

The protective coverings of the present invention comprise a housing component such as exemplary housing component 10 shown in FIGS. 1-11. FIG. 4 depicts a frontal view of exemplary protective covering 100 shown in FIG. 1 in a "closed configuration" with exemplary electronic device 200 removed from exemplary housing component 10 of exemplary protective covering 100. FIG. 5 depicts a frontal view of exemplary protective covering 100 shown in FIG. 4 in an "open configuration."

As used herein, the phrase "closed configuration" or "first closed position" refers to a configuration wherein an inner door surface 22 of exemplary door component 20 (see, FIG. 5) extends over an inner housing surface 13 of exemplary housing component 10 (see, FIGS. 4-5). Further, as used herein, the phrase "open configuration" or "second open position" refers to a configuration wherein inner door surface 22 of exemplary door component 20 faces upward (as shown in FIGS. 2 and 5) and inner housing surface 13 of exemplary housing component 10 is completely exposed (i.e., a user can view all of inner housing surface 13 as shown in FIG. 5).

As shown in FIGS. 4-8, exemplary housing component 10 comprises a lower housing layer 12 comprising a rear housing surface 11 (shown, for example, in FIGS. 3 and 6-8) and an inner housing surface 13 opposite rear housing surface 11. Exemplary housing component 10 further comprises one or more housing side walls 14 extending along a peripheral edge 15 of lower housing layer 12, wherein each of the one or more housing side walls 14 extends upward from lower housing layer 12 and comprises an outer housing side wall surface 16 and an inner housing side wall surface 17 opposite outer housing side wall surface 16.

Exemplary housing component 10 also comprises at least one housing connection member 18 extending along one of one or more housing side walls 14. As shown in FIGS. 4-5, in exemplary protective covering 100, housing connection members 18 extend along a first side edge housing side wall 19 extending along a portion of a first housing side edge 101.

As discussed above with reference to FIG. 3, rear housing surface 11 of exemplary housing component 10 also has a concave surface configuration 110 extending along at least a portion of rear housing surface 11 in a length direction L. In exemplary protective covering 100, concave surface configuration 110 extends along rear housing surface 11 from a point 102 having a minimal amount of concavity to a point 103 having a maximum amount of concavity. Concave surface configuration 110 contributes to the ability of exemplary protective covering 100 to be temporarily fixed to a user's leg (e.g., a user's thigh) (not shown).

In order to provide concave surface configuration 110 within rear housing surface 11, lower housing layer 12 of exemplary protective covering 100 has a first lower housing layer thickness at point 102 that is less than a second lower housing layer thickness at point 103. Typically, the second lower housing layer thickness at point 103 represents a maximum thickness of lower housing layer 12.

Figure 6:
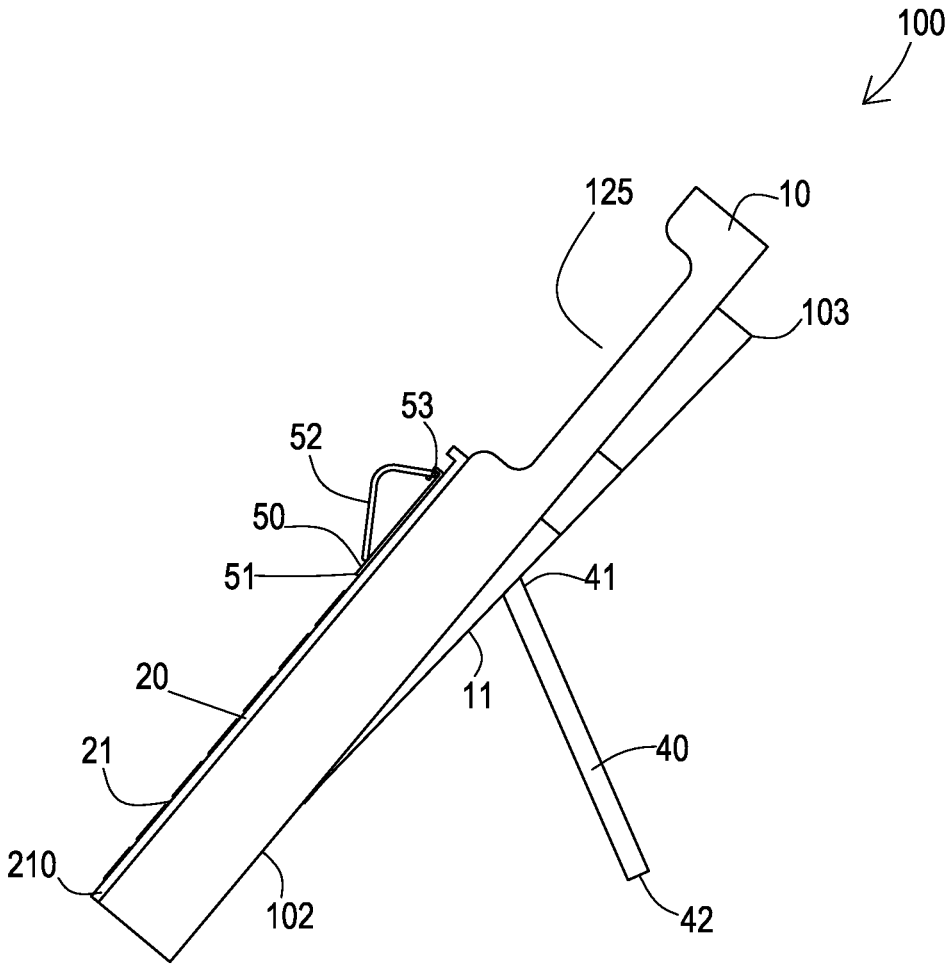
FIG. 6 depicts a side view of the exemplary protective covering shown in FIG. 4 as viewed along direction A with an exemplary fold-out prop member positioned in an angled position.
Figure 7:
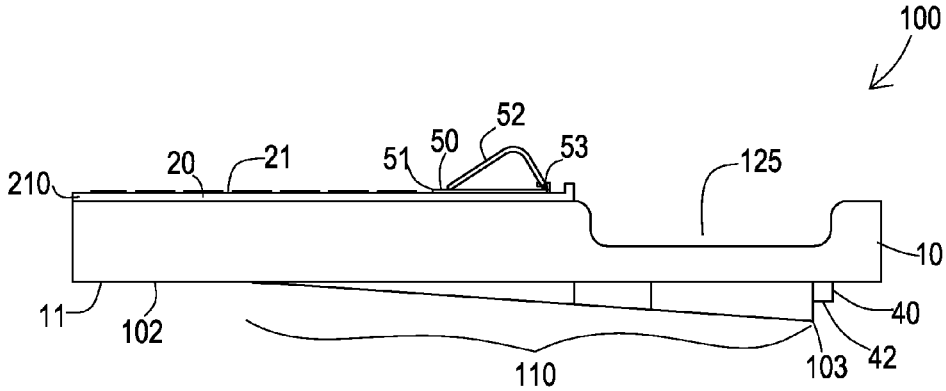
FIG. 7 depicts a side view of the exemplary protective covering shown in FIG. 4 as viewed along direction A with an exemplary fold-out prop member positioned in a parallel position wherein the fold-out prop member extends along and is proximate to a rear housing surface.

FIGS. 6-11 depict various views of concave surface configuration 110 of exemplary protective covering 100. FIG. 6 depicts a side view of exemplary protective covering 100 shown in FIG. 4 as viewed along direction A with exemplary fold-out prop member 40 (discussed further below) positioned in an angled position. FIG. 7 depicts a side view of exemplary protective covering 100 shown in FIG. 4 as viewed along direction A with exemplary fold-out prop member 40 positioned in a parallel position wherein exemplary fold-out prop member 40 extends along and is proximate to rear housing surface 11. As shown, exemplary fold-out prop member 40 extends along and within a recessed groove (discussed further below) along and within rear housing surface 11.

Figure 8:
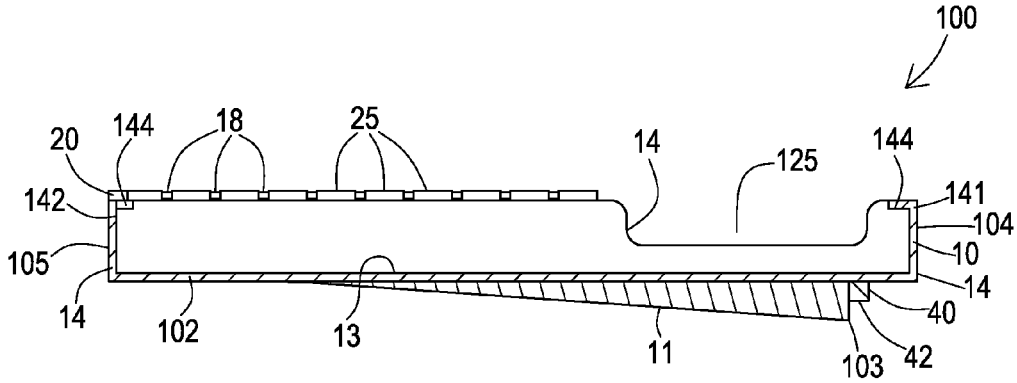
FIG. 8 depicts a cross-sectional view of the exemplary protective covering shown in FIG. 5 as viewed along line B-B with a door component of exemplary protective covering in an open position.

FIG. 8 depicts a cross-sectional view exemplary protective covering 100 shown in FIG. 5 as viewed along line B-B with exemplary door component 20 of exemplary protective covering 100 in an open position. As shown in FIG. 8, exemplary protective covering 100 comprises at least one housing side wall 14, wherein the housing side wall 14 further comprises a housing side wall portion that extends over and is spaced from said inner housing surface. In exemplary protective covering 100, upper edge housing side wall 141 extending along upper housing edge 104 and lower edge housing side wall 142 extending along lower housing edge 105 each independently comprise at least one housing side wall portion 144 that extends over and is spaced from inner housing surface 13.

As shown in FIG. 5, upper edge housing side wall 141 comprises a single upper edge side wall portion 144 that (i) extends over and is spaced from inner housing surface 13 and (ii) is centrally located along upper edge housing side wall 141. Further, as shown in FIG. 5, lower edge housing side wall 142 comprises two upper edge side wall portions 144 that (i) extend over and are spaced from inner housing surface 13 and (ii) are symmetrically distributed at locations along lower edge housing side wall 142.

Figure 9:
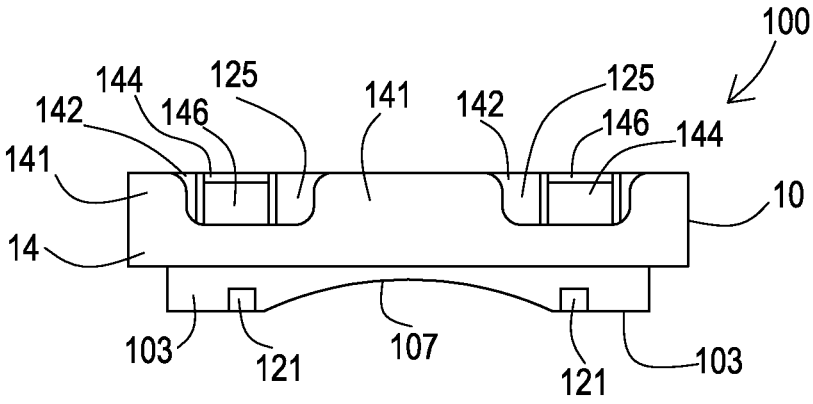
FIG. 9 depicts a side view of the exemplary protective covering shown in FIG. 4 as viewed along direction C with an exemplary fold-out prop member removed so as to show a concave surface configuration of a rear housing surface of a housing component.

FIG. 9 depicts a side view of exemplary protective covering 100 shown in FIG. 4 as viewed along direction C with exemplary fold-out prop member 40 removed so as to show concave surface configuration 110 of rear housing surface 11 of housing component 10. As shown in FIG. 9, concave surface configuration 110 has a concave shape passing through points 103 along outer edges of rear housing surface 11 and a centrally located point 107 along rear housing surface 11.

Figure 10:
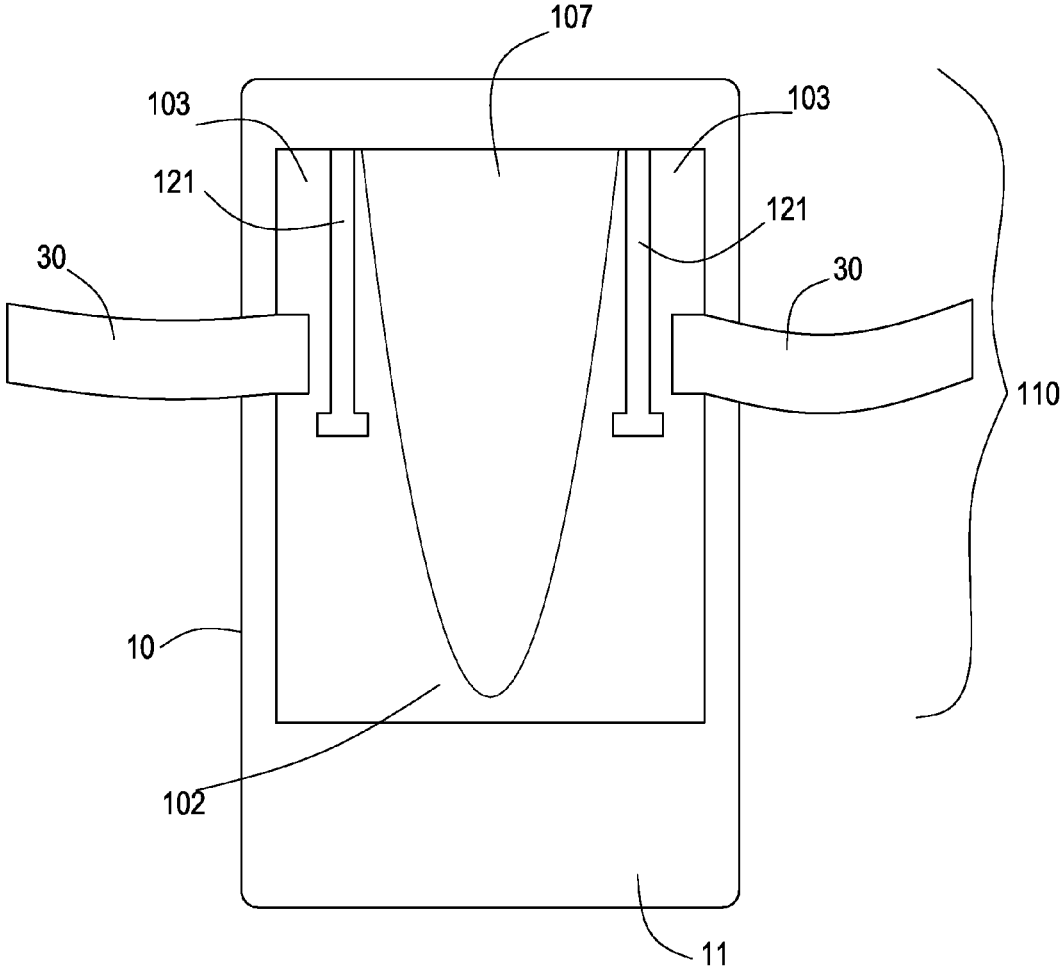
FIG. 10 depicts a rear view of the exemplary protective covering shown in FIG. 4 with an exemplary fold-out prop member removed so as to show (i) a recessed groove within the rear housing surface for housing the exemplary fold-out prop member when in a parallel position and (ii) the concave surface configuration of the rear housing surface.

FIG. 10 depicts a rear view of exemplary protective covering 100 shown in FIG. 4 with an exemplary fold-out prop member removed so as to show (i) recessed grooves 121 within rear housing surface 11 for housing the exemplary fold-out prop member when in a parallel position and (ii) concave surface configuration 110 of rear housing surface 11. In this exemplary embodiment, two separate recessed grooves, namely, recessed grooves 121, extend along at portion of rear housing surface 11. However, it should be understood that a single recessed groove (i.e., a single continuous recessed groove within rear housing surface 11) may be utilized to house a fold-out prop member of a given protective covering of the present invention.

Figure 11:
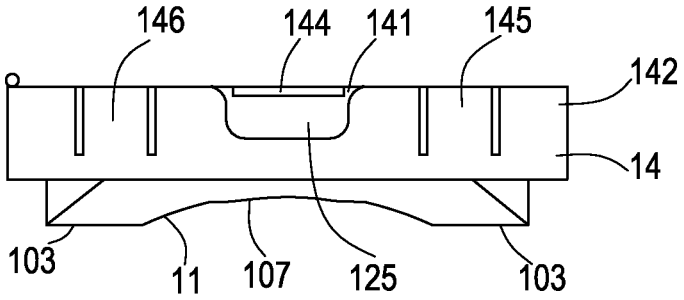
FIG. 11 depicts a side view of the exemplary protective covering shown in FIG. 4 as viewed along direction D showing a concave surface configuration of at least a portion of a rear housing surface of a housing component.

FIG. 11 depicts a side view of exemplary protective covering 100 shown in FIG. 4 as viewed along direction D showing concave surface configuration 110 of at least a portion of rear housing surface 11 of housing component 10. Further, as shown in FIG. 11, lower housing side wall 142 comprises housing clip members 145 and 146 extending along lower housing edge 105. Each of housing clip members 145 and 146 independently comprise housing side wall portion 144 that extends over and is spaced from inner housing surface 13. Each of housing clip members 145 and 146 independently assist in securing an electronic device within exemplary housing component 10 and along inner housing surface 13.

Typically, inner housing surface 13 of lower housing layer 12 has a substantially planar surface configuration within a first plane. However, it should be understood that inner housing surface 13 of lower housing layer 12 may have one or more undulations and/or openings within one or more areas of inner housing surface 13.

As shown in FIGS. 1-11 (see, in particular, FIG. 5), exemplary housing component 10 comprises (i) upper edge housing side wall 141 extending along at least a portion of upper edge 104 of housing component 10, (ii) lower edge housing side wall 142 extending along at least a portion of a lower edge 105 of housing component 10, lower edge 105 being opposite upper edge 104, (iii) a first side edge housing side wall 146 extending along at least a portion of first side edge 101 connecting upper and lower edges 104 and 105 of housing component 10, and (iv) a second side housing edge side wall 147 extending along at least a portion of a second side edge 106 connecting upper and lower edges 104 and 105 of housing component 10, second side edge 106 being opposite first side edge 101.

One or more of housing walls of a given housing component may further comprise comprises one or more openings or cut-outs (collectively, referred to as openings or cut-outs 125) therein so as to enable access to one or more controls or ports (collectively, referred to as controls or ports 203 as shown in FIGS. 1-3) positioned along an electronic device (e.g., electronic device 200 shown in FIGS. 1-3) positioned within a given housing component 10. For example, as shown in FIGS. 4-10, in one exemplary embodiment, each of (i) upper edge side wall 141, (ii) lower edge side wall 142, (iii) first side edge side wall 146 and (iv) second side edge side wall 147 comprises one or more openings or cut-outs 125 therein so as to enable access to one or more controls or ports 203 positioned along electronic device 200 positioned within housing component 10.

In desired embodiments, exemplary protective covering 100 for protecting and housing electronic device 200 comprises housing component 10 having a rectangular shape, an upper housing edge 104, a lower housing edge 105 opposite upper housing edge 104, a first housing side edge 101 connecting upper housing edge 104 and lower housing edge 105, and a second housing side edge 106 connecting upper housing edge 104 and lower housing edge 106 and being opposite first housing side edge 101, wherein housing component 10 comprises a shaped polymeric material comprising lower housing layer 12 comprising rear housing surface 11 and inner housing surface 13 opposite rear housing surface 11, wherein rear housing surface 11 has concave surface configuration 110 along at least a portion of rear housing surface 11, and inner housing surface 12 has a substantially planar surface configuration within a first plane; (i) upper edge housing side wall 141 extending along at least a portion of upper housing edge 104, (ii) lower edge housing side wall 142 extending along at least a portion of lower housing edge 105, (iii) first side edge housing side wall 146 extending along at least a portion of first housing side edge 101, and (iv) second side edge housing side wall 147 extending along at least a portion of second housing side edge 106; and a housing connection member 18 along first side edge housing side wall 101.

B. Door Component

The devices of the present invention further comprise a door component such as exemplary door component 20 shown in FIGS. 1-7. As shown in the figures, exemplary door 20 comprises an upper door layer 20 comprising an upper door surface 21, an inner door surface 22 opposite upper door surface 21, a connected door end 23, and a moveable door end 24 opposite connected door end 23; and at least one door connection member 25 along connected door end 24. Exemplary door component 20 is connected to housing component exemplary door component 10 along connected door end 23 so that moveable door end 24 is operatively adapted to move from (i) a first closed position wherein inner door surface 22 extends over inner housing surface 12 to (ii) a second open position wherein inner door surface 22 faces upward and inner housing surface 12 is completely exposed (e.g., an entire upper surface area of inner housing surface 12 is viewable by a user).

Typically, upper door surface 21 and inner door surface 22 are both substantially planar and extend within second and third planes, respectively, with second and third planes being substantially parallel with the first plane (that, in some embodiments, contains inner housing surface 12) when door component 20 is in the first closed position.

Exemplary door component 10 has door component dimensions such that, when exemplary door component 10 is in the first closed position, upper edge 141 and opposite side edges 101 and 106 of housing component 10 extend beyond door component 20 in the length direction (designated as arrow L in FIGS. 1 and 4) so that a user (not shown) can open door component 20 by extending one or more fingers between upper edge 26 of door component 20 and upper edge 141 of housing component 10.

In one exemplary embodiment, exemplary door 20 has a length (as measured in direction L shown in FIG. 1) of about 7.0 inches and is removeably attached to exemplary housing component 10 having a length (as measured in direction L shown in FIG. 1) of about 10.0 inches to allow unimpeded opening and closing of exemplary protective covering 100 in the cockpit of an aircraft. In this exemplary embodiment, corresponding housing component 10 and exemplary door 20 each independently have a width (as measured in perpendicular to direction L shown in FIG. 1) of about 7.5 to about 8.0 inches.

Typically, housing component 10 and door component 20 each independently comprise shaped polymeric materials. Further, typically, door component 20 is removable from housing component 10. In addition, desirably, outer and inner surfaces 21 and 22 of door component 20 provide a hard surface so that when door component 20 is in a closed or open position, a use may use either of outer and inner surfaces 21 and 22 of door component 20 as a support for writing on a document, for example, clipped to clip member 50.

In one desired embodiment, exemplary door component 20 has a square or rectangular configuration, an upper door edge 26, a lower door edge 27 opposite upper door edge 26, a first door side edge 28 connecting upper door edge 26 to lower door edge 27, and a second door side edge 29 connecting upper door edge 26 to lower door edge 27, second door side edge 29 being opposite first door side edge 28, wherein door component 20 comprises a shaped polymeric material comprising a door layer 210 comprising upper door surface 21, inner door surface 22 opposite upper door surface 21, connected door end 23, and moveable door end 24 opposite connected door end 23, each of upper door surface 21 and inner door surface 22 being substantially planar and extending within second and third planes respectively, the second and third planes being substantially parallel with the first plane (desirably containing inner housing surface 12) when door component 20 is in a first closed position; and at least one door connection member 25 extending along connected door end 23; door component 20 being connected to housing component 10 along connected door end 23 so that moveable door end 24 is operatively adapted to move from (i) the first closed position wherein inner door surface 22 extends over inner housing surface 12 to (ii) a second open position wherein inner door surface 22 faces upward and inner housing surface 12 is completely exposed; wherein when door component 20 is in the first closed position, (1) each of lower door edge 27, first door side edge 28 and second door side edge 29 is aligned with each of lower housing edge 142, first housing side edge 101 and second housing side edge 106 respectively, (2) upper door edge 26 extends along housing component 10 such that all of upper housing edge 141 and portions of first housing side edge 101 and second housing side edge 106 are exposed; and (3) each of (i) upper edge housing side wall 141, (ii) lower edge housing side wall 142, (iii) first side edge housing side wall 146 and (iv) second side edge housing side wall 147 comprises one or more openings or cut-outs 125 therein so as to enable access to one or more controls or ports 203 positioned along electronic device 200 positioned within housing component 10.

C. Fold-Out Prop Member

The devices of the present invention may further comprise a fold-out prop member component such as exemplary fold-out prop member 40 shown in FIGS. 1-3 and 6-8. The fold-out prop member can be deployed for use, or retracted into a groove 121 within housing component 10 when not in use (as shown in FIGS. 7-8).

FIG. 6 depicts a side view of exemplary protective covering 100 shown in FIG. 4 as viewed along direction A with exemplary fold-out prop member 40 positioned in an angled position. FIG. 7 depicts a side view of exemplary protective covering 100 shown in FIG. 4 as viewed along direction A with exemplary fold-out prop member 40 positioned in a parallel position wherein fold-out prop member 40 extends along and is proximate to rear housing surface 11.

Typically, fold-out prop member 40 comprising a connected fold-out prop member end 41, and a moveable fold-out prop member end 42 opposite connected fold-out prop member end 41. Connected fold-out prop member end 41 is typically connected to or proximate to rear housing surface 11 so that moveable fold-out prop member end 42 is operatively adapted to move from (i) a first parallel position wherein moveable fold-out prop member end 42 extends along and is proximate to (e.g., within a portion of) rear housing surface 11 as shown in FIGS. 3 and 7-8 to (ii) a second angled position wherein moveable fold-out prop member end 42 is positioned away from rear housing surface 11 as shown in FIGS. 1-2.

In desired embodiments, housing component 10 further comprises a recessed groove 121 extending along rear housing surface 11 as shown in FIG. 10, and fold-out prop member 40 is sized so that at least a portion of fold-out prop member 40 fits within recessed groove 121 when fold-out prop member 40 is in the first parallel position (as shown in FIGS. 3 and 7-8).

Desirably, fold-out prop member 40 is operatively adapted to remain in a first parallel position or a second angled position unless a threshold amount of force is applied to fold-out prop member 40.

D. Strap(s)

The devices of the present invention may further comprise one or more straps such as exemplary straps 30 shown in FIGS. 1-3. Exemplary straps 30 extend from exemplary housing component 10. As shown in FIG. 3, exemplary straps 30 may extend from rear housing surface 11 of exemplary housing component 10.

Exemplary straps 30 are operatively adapted and sized to extend around a person's thigh (not shown) so as to attach exemplary protective covering 100 to the person's thigh. As shown in FIG. 3, exemplary protective covering 100 comprises two exemplary straps 30 extending from rear housing surface 11 of exemplary housing component 10. It should be understood that, in some exemplary embodiments, the protective covering of the present invention may comprise a single strap extending through slots (not shown) within the housing component (e.g., exemplary housing component 10).

The one or more straps comprise a strap locking mechanism operatively adapted to temporarily secure a length of the one or more straps in a fixed position. As shown in FIG. 3, exemplary straps 30 comprise a strap locking mechanism in the form of hook and loop material 31 (e.g., VELCRO™ material) positioned along outer surfaces 32 of exemplary straps 30. In other embodiments, a suitable strap locking mechanism may comprise an adhesive component (e.g., a pressure sensitive tape), a bucket (not shown) attached to one portion of the one or more straps and attachable to another portion of the one or more straps, or any other male/female connector combination (not shown) that enables one portion of the one or more straps to be temporarily fixed (e.g., attached) to another portion of the one or more straps.

E. Clip Member

The devices of the present invention may further comprise a clip member component such as exemplary clip member 50 shown in FIGS. 1, 4 and 6-7. As shown in FIGS. 1, 4 and 6-7, exemplary clip member 50 is positioned along upper door surface 21 of exemplary door component 20. Exemplary clip member 50 is operatively adapted and sized to clip objects (not shown), such as paper, pens, etc., to upper door surface 21.

Exemplary clip member 50 may be formed from any material and comprise any number of components so as to clip one or more objects (not shown) to upper door surface 21. Typically, exemplary clip member 50 and its components are formed from a metal material, such as steel or stainless steel. However, exemplary clip member 50 and its components may be formed from any combination of metal, wood, and polymeric materials.

In one exemplary embodiment, exemplary clip member 50 comprises a clip member base 51, a clip 52, and an elastic member 53 (e.g., a spring) that applies an elastic force onto clip 52 so that a front movable end 54 of clip 52 is forced downward toward clip member base 51. A threshold amount of force is needed to overcome the elastic force so as to move front movable end 54 of clip 52 upward, away from clip member base 51.

II. Methods of Making Protective Coverings

The present invention is also directed to methods of making protective coverings. In one exemplary embodiment of the present invention, the method of making a protective covering comprises the step of forming at least one molded part comprising (i) the housing component, (ii) the fold-out prop member, and (iii) the door component;

and connecting (i) the housing component, (ii) the fold-out prop member, and (iii) the door component. The method of making a protective covering may further comprise one or more additional steps including, but not limited to, printing and/or adhering an image onto an outer surface of the at least one molded part; attaching one or more self-adhesive pads on one or more surfaces of the housing component (e.g., along inner housing surface 13, rear housing surface 11, any housing side wall, any surface of (i) upper edge housing side wall 141, (ii) lower edge housing side wall 142, (iii) first side edge housing side wall 146, and (iv) second side edge housing side wall 147); forming a clip member; attaching the clip member to an outer surface of the door component (e.g., via adhesive or screws); attaching one or more straps to the housing component; and packaging the protective covering.

Typically, each of the components of the protective coverings of the present invention is formed via one or more thermoforming steps (e.g., one or more injection molding step). Each of the components of the protective coverings may be formed from any desired material. Typically, each of the components of the protective coverings comprises a thermoformable material such as a polymeric material. Suitable polymeric materials for forming each of the components of the protective coverings include, but are not limited to, a polyolefin (e.g., polyethylene, polypropylene, copolymers of ethylene and propylene), a polyester (e.g., PET), polyvinyl chloride, a polyacrylate (e.g., polymethyl methacrylate), or any other thermoformable polymer.

III. Methods of Using Protective Coverings

The present invention is further directed to methods of using a protective covering to protect and house an electronic device. In one exemplary embodiment of the present invention, the method of using a protective covering comprises a method of covering an electronic device, wherein the method comprises positioning the electronic device along an inner surface of the housing component; and closing the protective covering so as to protect and house the electronic device within the housing component.

In other exemplary embodiments, the method of using a protective covering comprises opening a protective covering having an electronic device positioned therein; withdrawing a fold-out prop member from a first position adjacent a lower surface of the housing component; and adjusting a height of the electronic device by adjusting a position of the fold-out prop member relative to the housing component.

In yet other exemplary embodiments, the method of using a protective covering comprises strapping a protective covering to a person's thigh; optionally attaching one or more cords (e.g., a power cord) to an electronic device positioned within a housing component of the protective covering; and opening a door component of the protective covering to access an upper surface of the electronic device (e.g., a touch screen of the electronic device) positioned within the housing component of the protective covering.

The method of using a protective covering of the present invention may further comprise one or more steps. Suitable additional steps may include, but are not limited to, clipping (or unclipping) one or more objects (e.g., papers, pens, etc.) to (or from) a clip member; viewing a portion of a screen 201 of an electronic device 200 positioned within exemplary housing component 10, while door component 20 is in a closed position; writing on a document positioned along outer door surface 21 when door component 20 is in a closed position; opening door component 20 so as to view a complete screen 201 of an electronic device 200 positioned within exemplary housing component 10; and removing (or reattaching) door component 20 from (to) housing component 10.

The present invention is described above and further illustrated below by way of examples, which are not to be construed in any way as imposing limitations upon the scope of the invention. On the contrary, it is to be clearly understood that resort may be had to various other embodiments, modifications, and equivalents thereof which, after reading the description herein, may suggest themselves to those skilled in the art without departing from the spirit of the present invention and/or the scope of the appended claims.

Example 1

Preparation of a Protective Covering

Exemplary protective coverings as shown in FIGS. 1-11 were prepared using conventional steps (e.g., one or more thermoforming steps, and one or more connection steps).

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A protective covering for protecting and housing an electronic device, said protective covering comprising:

(I) a housing component comprising:

a lower housing layer comprising a rear housing surface and an inner housing surface opposite said rear housing surface;

one or more housing side walls extending along a peripheral edge of said lower housing layer, each of said one or more housing side walls extending upward from said lower housing layer and comprising an outer housing side wall surface and an inner housing side wall surface opposite said outer housing side wall surface;

an upper edge housing side wall portion that extends (i) outward from said one or more housing side walls and (ii) over and spaced from said inner housing surface, said upper edge housing side wall portion being positioned along an upper edge of said housing component; and at least one housing connection member extending along one of said one or more housing side walls, and substantially perpendicular to said upper edge of said housing component;

(II) a door component comprising:

an upper door layer comprising an upper door surface, an inner door surface opposite said upper door surface, a connected door end, and a moveable door end opposite said connected door end;

a clip member positioned along said upper door surface, said clip member being operatively adapted and sized to clip objects to said upper door surface; and at least one door connection member along said connected door end;

said door component (1) being connected to said housing component along said connected door end so that said moveable door end is operatively adapted to move from (i) a first closed position wherein said inner door surface extends over said inner housing surface to (ii) a second open position wherein said inner door surface faces upward and said inner housing surface is completely exposed, and (2) having door component dimensions such that, when said door component is in the first closed position, said upper edge and opposite side edges of said housing component extend beyond said door component in a length direction of said housing component so that a user can open said door component by extending one or more fingers between an upper edge of said door component and said upper edge housing side wall portion of said housing component; and (III) one or more straps extending from said housing component and one or more strap locking mechanisms operatively adapted to temporarily secure a length of said one or more straps in a fixed position, said one or more straps being operatively adapted and sized to extend around a person's thigh so as to attach said protective covering to the person's thigh.

2. The protective covering of claim 1, wherein an inner housing surface has a substantially planar surface configuration within a first plane.

3. The protective covering of claim 2, wherein said upper door surface and said inner door surface are both substantially planar and extend within second and third planes respectively, said second and third planes being substantially parallel with said first plane when said door component is in the first closed position.

4. The protective covering of claim 1, wherein said housing component and said door component each independently comprise shaped polymeric materials, and wherein said door component is removable from said housing component.

5. The protective covering of claim 1, wherein said housing component comprises (i) an upper edge housing side wall extending along at least a portion of said upper edge of said housing component, (ii) a lower edge housing side wall extending along at least a portion of a lower edge of said housing component, said lower edge being opposite said upper edge, (iii) a first side edge housing side wall extending along at least a portion of a first side edge connecting said upper and lower edges of said housing component, and (iv) a second side edge housing side wall extending along at least a portion of a second side edge connecting said upper and lower edges of said housing component, said second side edge being opposite said first side edge; said door component being connected to said housing component along said first side edge housing side wall or said second side edge housing side wall.

6. The protective covering of claim 5, wherein said lower edge housing side wall further comprises at least one lower edge housing side wall portion that extends (i) outward from said lower edge housing side wall and (ii) over and is spaced from said inner housing surface.

7. The protective covering of claim 5, wherein each of (i) said upper edge housing side wall, (ii) said lower edge housing side wall, (iii) said first side edge housing side wall and (iv) said second side edge housing side wall independently comprises one or more openings or cut-outs therein so as to enable access to one or more controls or ports positioned along an electronic device positioned within said housing component.

8. The protective covering of claim 1, further comprising:

a fold-out prop member comprising a connected fold-out prop member end, and a moveable fold-out prop member end opposite said connected fold-out prop member end, said connected fold-out prop member end being connected to or proximate to said rear housing surface so that said moveable fold-out prop member end is operatively adapted to move from (i) a first parallel position wherein said moveable fold-out prop member end extends along and is proximate to said rear housing surface to (ii) a second angled position wherein said moveable fold-out prop member end is positioned away from said rear housing surface.

9. The protective covering of claim 8, wherein said housing component further comprises a recessed groove extending along said rear housing surface, and said fold-out prop member is sized so as to fit within said recessed groove when said fold-out prop member is in the first parallel position.

10. The protective covering of claim 1 in combination with an electronic device, said protective covering and said electronic device being sized so that said electronic device can be secured to said housing component and positioned within said housing component when said moveable door end is in the first closed position.

11. The protective covering of claim 1, wherein said rear housing surface has a centrally located concave surface configuration extending along at least a portion of said rear housing surface in the length direction of said housing component, said centrally located concave surface configuration extending from a first point having a minimal amount of concavity to a second point having a maximum amount of concavity, said lower housing layer having a first lower housing layer thickness at said first point that is less than a second lower housing layer thickness at said second point.

12. A protective covering for protecting and housing an electronic device, said protective covering comprising:

(I) a housing component having a rectangular shape, an upper housing edge, a lower housing edge opposite said upper housing edge, a first housing side edge connecting said upper housing edge and said lower housing edge, and a second housing side edge connecting said upper housing edge and said lower housing edge and being opposite said first housing side edge, said housing component comprising:

a lower housing layer comprising a rear housing surface and an inner housing surface opposite said rear housing surface, said inner housing surface having a substantially planar surface configuration within a first plane;

(i) an upper edge housing side wall extending along at least a portion of said upper housing edge, (ii) a lower edge housing side wall extending along at least a portion of said lower housing edge, (iii) a first side edge housing side wall extending along at least a portion of said first housing side edge, and (iv) a second side edge housing side wall extending along at least a portion of said second housing side edge;

an upper edge housing side wall portion that extends (i) outward from said upper edge housing side wall and (ii) over and spaced from said inner housing surface; and a housing connection member along said first side edge housing side wall;

(II) one or more straps extending from said housing component and (ii) one or more strap locking mechanisms operatively adapted to temporarily secure a length of said one or more straps in a fixed position, said one or more straps being operatively adapted and sized to extend around a person's thigh so as to attach said protective covering to the person's thigh; and (III) a door component having a square or rectangular configuration, an upper door edge, a lower door edge opposite said upper door edge, a first door side edge connecting said upper door edge to said lower door edge, and a second door side edge connecting said upper door edge to said lower door edge, said second door side edge being opposite said first door side edge, said door component comprising:

an upper door layer comprising an upper door surface, an inner door surface opposite said upper door surface, a connected door end, and a moveable door end opposite said connected door end, each of said upper door surface and said inner door surface being substantially planar and extending within second and third planes respectively, said second and third planes being substantially parallel with said first plane when said door component is in a first closed position;

a clip member positioned along said upper door surface, said clip member being operatively adapted and sized to clip objects to said upper door surface; and at least one door connection member extending along said connected door end;

said door component being connected to said housing connection member along said first side edge housing side wall of said housing component via said connected door end so that said moveable door end is operatively adapted to move from (i) the first closed position wherein said inner door surface extends over said inner housing surface to (ii) a second open position wherein said inner door surface faces upward and said inner housing surface is completely exposed;

wherein when said door component is in the first closed position, (1) each of said lower door edge, said first door side edge and said second door side edge is aligned with each of said lower housing edge, said first housing side edge and said second housing side edge respectively, (2) said upper door edge extends along said housing component such that all of said upper housing edge and portions of said first housing side edge and said second housing side edge are exposed; and (3) each of (i) said upper edge housing side wall, (ii) said lower edge housing side wall, (iii) said first side edge housing side wall and (iv) said second side edge housing side wall comprises an opening or cut-out therein so as to enable access to one or more controls or ports positioned along an electronic device positioned within said housing component.

13. The protective covering of claim 12 in combination with an electronic device, said protective covering and said electronic device being sized so that said electronic device can be secured to said housing component and positioned within said housing component when said moveable door end is in the first closed position.

14. The protective covering of claim 12, wherein said housing component and said door component each independently comprise a shaped polymeric material.

15. The protective covering of claim 14, wherein said lower edge housing side wall further comprises at least one lower edge housing side wall portion that extends (i) outward from said inner housing side wall surface and (ii) over and spaced from said inner housing surface.

16. The protective covering of claim 12, wherein (i) said door component has a length of about 7.0 inches and a width of about 7.5 to about 8.0 inches, and (ii) said housing component has a length of about 10.0 inches and a width of about 7.5 to about 8.0 inches.

17. A protective covering for protecting and housing an electronic device, said protective covering comprising:

(I) a housing component having a rectangular shape, an upper housing edge, a lower housing edge opposite said upper housing edge, a first housing side edge connecting said upper housing edge and said lower housing edge, and a second housing side edge connecting said upper housing edge and said lower housing edge and being opposite said first housing side edge, said housing component comprising:

a lower housing layer comprising a rear housing surface and an inner housing surface opposite said rear housing surface, said rear housing surface having a concave surface configuration along at least a portion of said rear housing surface in a length direction of said housing component, said concave surface configuration extending from a first point having a minimal amount of concavity to a second point having a maximum amount of concavity, said lower housing layer having a first lower housing layer thickness at said first point that is less than a second lower housing layer thickness at said second point, and said inner housing surface having a substantially planar surface configuration within a first plane;

(i) an upper edge housing side wall extending along at least a portion of said upper housing edge, (ii) a lower edge housing side wall extending along at least a portion of said lower housing edge, (iii) a first side edge housing side wall extending along at least a portion of said first housing side edge, and (iv) a second side edge housing side wall extending along at least a portion of said second housing side edge;

an upper edge housing side wall portion that extends (i) outward from said upper edge housing side wall and (ii) over and spaced from said inner housing surface; and a housing connection member along said first side edge housing side wall;

(II) (i) one or more straps extending from said housing component and (ii) one or more strap locking mechanisms operatively adapted to temporarily secure a length of said one or more straps in a fixed position, said one or more straps being operatively adapted and sized to extend around a person's thigh so as to attach said protective covering to the person's thigh; and (III) a door component having a square or rectangular configuration, an upper door edge, a lower door edge opposite said upper door edge, a first door side edge connecting said upper door edge to said lower door edge, and a second door side edge connecting said upper door edge to said lower door edge, said second door side edge being opposite said first door side edge, said door component comprising:

an upper door layer comprising an upper door surface, an inner door surface opposite said upper door surface, a connected door end, and a moveable door end opposite said connected door end, each of said upper door surface and said inner door surface being substantially planar and extending within second and third planes respectively, said second and third planes being substantially parallel with said first plane when said door component is in a first closed position;

a clip member positioned along said upper door surface, said clip member being operatively adapted and sized to clip objects to said upper door surface; and at least one door connection member extending along said connected door end;

said connected door end being connected to said housing connection member so that said moveable door end is operatively adapted to move from (i) the first closed position wherein said inner door surface extends over said inner housing surface to (ii) a second open position wherein said inner door surface faces upward and said inner housing surface is completely exposed;

wherein when said door component is in the first closed position, (1) each of said lower door edge, said first door side edge and said second door side edge is aligned with each of said lower housing edge, said first housing side edge and said second housing side edge respectively, (2) said upper door edge extends along said housing component such that all of said upper housing edge and portions of said first housing side edge and said second housing side edge are exposed; and (3) each of (i) said upper edge housing side wall, (ii) said lower edge housing side wall, (iii) said first side edge housing side wall and (iv) said second side edge housing side wall comprises an opening or cut-out therein so as to enable access to one or more controls or ports positioned along an electronic device positioned within said housing component.

18. The protective covering of claim 17 in combination with an electronic device, said protective covering and said electronic device being sized so that said electronic device can be secured to said housing component and positioned within said housing component when said moveable door end is in the first closed position.

19. The protective covering of claim 17, wherein said rear housing surface further comprises a recessed groove extending along said rear housing surface; and said protective covering further comprises a fold-out prop member comprising a connected fold-out prop member end, and a moveable fold-out prop member end opposite said connected fold-out prop member end, said connected fold-out prop member end being connected to or proximate to said rear housing surface so that said moveable fold-out prop member end is operatively adapted to move from (i) a first parallel position wherein said moveable fold-out prop member end extends along and is proximate to said rear housing surface to (ii) a second angled position wherein said moveable fold-out prop member end is positioned away from said rear housing surface, said fold-out prop member being sized so as to fit within said recessed groove when said fold-out prop member is in the first parallel position.

20. The protective covering of claim 19, wherein said housing component and said door component each independently comprise a shaped polymeric material; and said lower edge housing side wall further comprises at least one lower edge housing side wall portion that extends (i) outward from said inner housing side wall surface and (ii) over and spaced from said inner housing surface.

* * * * *